US011992915B2

(12) United States Patent
Uozumi et al.

(10) Patent No.: US 11,992,915 B2
(45) Date of Patent: May 28, 2024

(54) SYSTEM FOR ADJUSTING PAD SURFACE TEMPERATURE AND POLISHING APPARATUS

(71) Applicant: EBARA CORPORATION, Tokyo (JP)

(72) Inventors: Shuji Uozumi, Tokyo (JP); Toru Maruyama, Tokyo (JP); Mitsunori Komatsu, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 270 days.

(21) Appl. No.: 17/115,764

(22) Filed: Dec. 8, 2020

(65) Prior Publication Data

US 2021/0170545 A1 Jun. 10, 2021

(30) Foreign Application Priority Data

Dec. 9, 2019 (JP) ..... 2019-221931

(51) Int. Cl.
*B24B 55/03* (2006.01)
*B24B 37/015* (2012.01)
*B24B 37/20* (2012.01)

(52) U.S. Cl.
CPC ..... *B24B 55/03* (2013.01); *B24B 37/015* (2013.01); *B24B 37/20* (2013.01)

(58) Field of Classification Search
CPC ..... B24B 55/03; B24B 37/015; B24B 37/20; B24B 37/04; B24B 37/005; B24B 37/042; B24B 37/10; B24B 37/105; B24B 37/107; B24B 37/34; B24B 57/02; B24B 49/14; B24B 53/017; B24B 53/02; B24B 53/095; H01L 21/67092
See application file for complete search history.

(56) References Cited

U.S. PATENT DOCUMENTS 6,158,447 A * 12/2000 Kamikawa ..... B08B 3/08 257/E21.228
9,782,870 B2 10/2017 Maruyama et al.
2011/0081840 A1* 4/2011 Schwandner ..... B24D 15/06 451/60

FOREIGN PATENT DOCUMENTS

CN 207877348 U * 9/2018 ..... C02F 1/52
CN 209485130 U * 10/2019 ..... F28F 27/00
CN 110449081 A * 11/2019 ..... B24B 57/02
JP 2016007652 A * 1/2016 ..... B24B 37/015
JP 2017148933 8/2017
JP 2018122406 A * 8/2018 ..... B24B 37/015
KR 20170124991 A * 11/2017 ..... F01K 13/02

OTHER PUBLICATIONS

English translation of JP 2016007652A (Year: 2016).*
English translation of CN 207877348U (Year: 2018).*
(Continued)

*Primary Examiner* — Laura C Guidotti
*Assistant Examiner* — Sukwoo James Chang
(74) *Attorney, Agent, or Firm* — JCIPRNET

(57) ABSTRACT

A system (5) includes a heat exchanging member (11) and a liquid supply unit (30). The liquid supply unit (30) includes a pump device (32) that adjusts the flow amount of a liquid flowing through a heating liquid supply line (HSL), a needle valve (MNV) that is attached to a cooling liquid supply line (CSL), and a control device (40) that controls operations of the pump device (32) and the needle valve (MNV).

13 Claims, 9 Drawing Sheets

(56) References Cited

OTHER PUBLICATIONS

English translation of JP 2018122406A (Year: 2018).*
English translation of CN 209485130U (Year: 2019).*
English translation of KR20170124991A (Year: 2017).*
English translation of CN110449081A (Year: 2019).*

* cited by examiner

SYSTEM FOR ADJUSTING PAD SURFACE TEMPERATURE AND POLISHING APPARATUS

CROSS-REFERENCE TO RELATED APPLICATION

This application claims the priority of Japan patent application serial no. 2019-221931, filed on Dec. 9, 2019. The entirety of the above-mentioned patent application is hereby incorporated by reference herein and made a part of this specification.

BACKGROUND

Technical Field

The present invention relates to a system for adjusting a pad surface temperature and a polishing apparatus.

Description of Related Art

A wafer polishing rate depends not only on a polishing load on a wafer polishing pad but also on a surface temperature of the polishing pad. This is because chemical actions of a polishing solution on a wafer depend on the temperature. Therefore, it is important to maintain the surface temperature of the polishing pad at an optimal value during wafer polishing in order to increase and also maintain a constant wafer polishing rate in manufacturing of a semiconductor device.

Thus, a pad temperature adjustment system for adjusting a surface temperature of a polishing pad is known. The pad temperature adjustment system includes a pad contact member that comes into contact with the surface of the polishing pad and a liquid supply line that is connected to the pad contact member.

PATENT DOCUMENTS

[Patent Document 1] Japanese Patent Laid-Open No. 2017-148933

There may be a case in which a liquid supply line is connected to a liquid supply source provided in a plant where a polishing apparatus is placed. In such a case, various devices are disposed between the liquid supply line and the liquid supply source, the flow amount of the liquid flowing through the liquid supply line being thus affected by a back pressure of a plant facility. Therefore, an apparatus that adjusts the flow amount of the liquid flowing through the liquid supply line (that is, a flow amount adjustment apparatus) is affected by the back pressure, and as a result, there is a concern that it may not be possible to precisely control the flow amount of the liquid to be supplied to a pad contact member.

Such a phenomenon may occur due to not only the influence of a back pressure but also the type of flow amount adjustment apparatus which is applied. In other words, although it is desirable that the flow amount of the liquid flowing through the liquid supply line be precisely controlled between a small flow amount region and a large flow amount region, there is a concern that it may not be possible to precisely control the flow amount of the liquid to be supplied to the pad contact member depending on the flow amount adjustment apparatus to be applied.

Thus, according to an aspect of the invention, there is provided a system capable of precisely controlling the flow amount of a liquid flowing through a liquid supply line.

According to another aspect of the invention, there is provided a polishing apparatus provided with a system capable of precisely controlling the flow amount of a liquid flowing through a liquid supply line.

SUMMARY

According to an aspect of the present invention, there is provided a system including: a heat exchanging member that is capable of exchanging heat with a surface of a pad; and a liquid supply unit that supplies a liquid to the heat exchanging member, in which the liquid supply unit includes a pump device that adjusts a flow amount of a liquid flowing through a heating liquid supply line, a needle valve that is attached to a cooling liquid supply line, and a control device that controls operations of the pump device and the needle valve.

According to an aspect, the liquid supply unit includes a flow amount switching unit that switches a flow amount of a liquid flowing through the cooling liquid supply line.

According to an aspect, the flow amount switching unit includes a pressure regulator and a first opening/closing valve that are attached to the cooling liquid supply line, a bypass line that bypasses the pressure regulator and the first opening/closing valve, and a second opening/closing valve that is attached to the bypass line.

According to an aspect, the liquid supply unit includes a pulsation attenuator disposed on an upstream side of the needle valve in a flowing direction of the liquid flowing through the cooling liquid supply line.

According to an aspect, the pump device includes at least one pump, and a pump controller that controls operations of the pump.

According to an aspect, there is provided a system including: a heat exchanging member that is capable of exchanging heat with a surface of a pad; and a liquid supply unit that supplies a liquid to the heat exchanging member, in which the liquid supply unit includes a pump device that adjusts a flow amount of a liquid flowing through a heating liquid supply line, a pump unit that is capable of operating on the basis of a pressure difference between a pressure of a liquid flowing through a cooling liquid supply line and a pressure of a liquid flowing through a cooling liquid returning line, and a control device that controls operations of the pump device and the pump unit.

According to an aspect, the liquid supply unit includes a supply-side pressure sensor that is attached to the cooling liquid supply line, and a returning-side pressure sensor that is attached to the cooling liquid returning line, and the control device calculates a pressure difference on the basis of a pressure measured by the supply-side pressure sensor and a pressure measured by the returning-side pressure sensor, and controls operations of the pump unit such that the calculated pressure difference reaches a target pressure on the basis of a correlation between the flow amount of the liquid flowing through the cooling liquid supply line and the pressure difference between the pressure of the liquid flowing through the cooling liquid supply line and the pressure of the liquid flowing through the cooling liquid returning line.

According to an aspect, the liquid supply unit includes a pressure regulator that is attached to the cooling liquid supply line.

According to an aspect, the liquid supply unit includes a needle valve that is attached to the cooling liquid supply line, a bypass line that bypasses the needle valve, and an opening/closing valve that is attached to the bypass line.

According to an aspect, the liquid supply unit includes a pulsation attenuator disposed on an upstream side of the needle valve in a flowing direction of the liquid flowing through the cooling liquid supply line.

According to an aspect, the pump device includes at least one pump, and a pump controller that controls operations of the pump.

According to an aspect, there is provided a polishing apparatus including: a polishing head that holds a substrate and causes the substrate to rotate; a polishing table that supports a polishing pad; a polishing solution supply nozzle that supplies a polishing solution to a surface of the polishing pad; and the aforementioned system.

DESCRIPTION OF THE EMBODIMENTS

Each of the pump device and the needle valve controls the flow amount of the liquid such that it is within a flow amount control range that is a wide range from a small flow amount region to a large flow amount region. The pad temperature adjustment system can thus precisely control the flow amount of the liquid to be supplied to the heat exchanging member.

Figure 1:
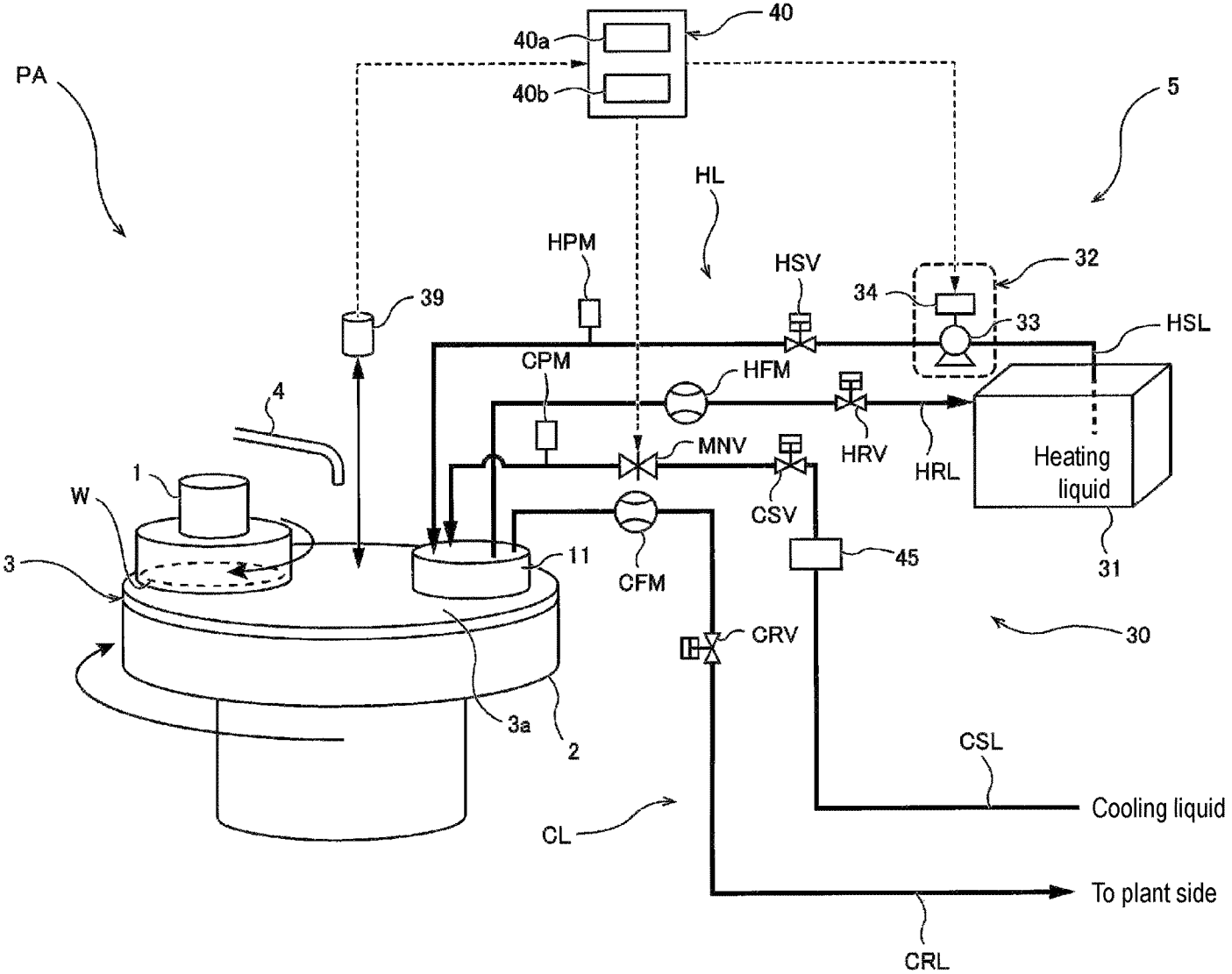
FIG. 1 a schematic diagram illustrating an embodiment of a polishing apparatus.

FIG. 1 is a schematic diagram illustrating an embodiment of a polishing apparatus. As illustrated in FIG. 1, a polishing apparatus PA includes a polishing head 1 that holds a wafer W as an example of a substrate and causes the wafer W to rotate, a polishing table 2 that supports a polishing pad 3, a polishing solution supply nozzle 4 that supplies a polishing solution (for example, a slurry) to a surface 3*a* of the polishing pad 3, and a pad temperature adjustment system 5 that adjusts a surface temperature of the polishing pad 3. The surface (upper surface) 3*a* of the polishing pad 3 configures a polishing surface to polish the wafer W.

The polishing head 1 is capable of moving in the vertical direction and is capable of rotating about the axial center thereof in the direction indicated by the arrow. The wafer W is held at the lower surface of the polishing head 1 using vacuum adsorption or the like. A motor (not illustrated) is coupled to the polishing table 2, and the polishing table 2 is capable of rotating in the direction indicated by the arrow. As illustrated in FIG. 1, the polishing head 1 and the polishing table 2 rotate in the same direction. The polishing pad 3 is attached to the upper surface of the polishing table 2.

Polishing of the wafer W is performed as follows. The wafer W to be polished is held by the polishing head 1 and is further rotated by the polishing head 1. The polishing pad 3 is rotated along with the polishing table 2. The polishing solution is supplied from the polishing solution supply nozzle 4 to the surface 3*a*of the polishing pad 3, and further, the surface of the wafer W is pressed against the surface 3*a*of the polishing pad 3, that is, the polishing surface by the polishing head 1. The surface of the wafer W is polished through rubbing contact with the polishing pad 3 in the presence of the polishing solution. The surface of the wafer W is flattened by a chemical action of the polishing solution and a mechanical action of abrasive grains contained in the polishing solution.

The pad temperature adjustment system 5 includes a heat exchanging member 11 with a flow path through which a liquid for adjusting the surface temperature of the polishing pad 3 flows formed therein and a liquid supply unit 30 that supplies liquids (more specifically, a heating liquid and a cooling liquid) with adjusted temperatures to the heat exchanging member 11.

The heat exchanging member 11 is a member that is capable of exchanging heat with the surface 3*a* of the polishing pad 3. The heat exchanging member 11 may be configured to come into contact with the surface 3*a*of the polishing pad 3 to adjust the temperature of the surface 3*a*or may be configured to adjust the temperature of the surface 3*a*without any contact with the surface 3*a*of the polishing pad 3.

The liquid supply unit 30 includes a heating liquid supply tank 31 that stores the heating liquid with an adjusted temperature, a heating liquid line HL, which is connected to the heating liquid supply tank 31, through which the heating liquid flows, and a cooling liquid line CL through which the cooling liquid flows.

The heating liquid line HL includes a heating liquid supply line HSL and a heating liquid returning line HRL that couple the heating liquid supply tank 31 and the heat exchanging member 11. One end of each of the heating liquid supply line HSL and the heating liquid returning line HRL is connected to the heating liquid supply tank 31 while the other ends thereof are connected to the heat exchange member 11.

The liquid supply unit 30 includes a pump device 32 that adjusts the flow amount of the heating liquid flowing through the heating liquid supply line HSL and a control device 40 that controls operations of the pump device 32. The pump device 32 is configured to circulate the heating solution between the heating liquid supply tank 31 and the heat exchanging member 11.

The pump device 32 includes a pump 33 that is connected to the heating liquid supply line HSL and a pump controller 34 that controls operations of the pump 33. The pump 33 is a pump that is capable of operating at a low speed and at a high speed to supply a small flow amount of heating liquid and a large flow amount of heating liquid to the heat exchanging member 11. The pump controller 34 is electrically connected to the control device 40 and controls operations of the pump 33 on the basis of commands from the control device 40.

If the pump device 32 is driven, then the heating liquid with an adjusted temperature is supplied from the heating liquid supply tank 31 to the heat exchanging member 11 through the heating liquid supply line HSL and is then returned from the heat exchanging member 11 to the heating liquid supply tank 31 through the heating liquid returning line HRL. The heating liquid supply tank 31 includes a heater (not illustrated) disposed therein, and the heating liquid is heated to a predetermined temperature by the heater.

In the embodiment illustrated in FIG. 1, the flow amount of the heating liquid to be supplied to the heat exchanging member 11 is controlled by the pump device 32. The pump device 32 connected to the heating liquid supply line HSL can control the flow amount of heating liquid within a flow amount control range that is a wide range from a small flow amount region to a large flow amount region. The pad temperature adjustment system 5 can thus precisely control the flow amount of heating liquid flowing through the heating liquid supply line HSL.

Figure 2:
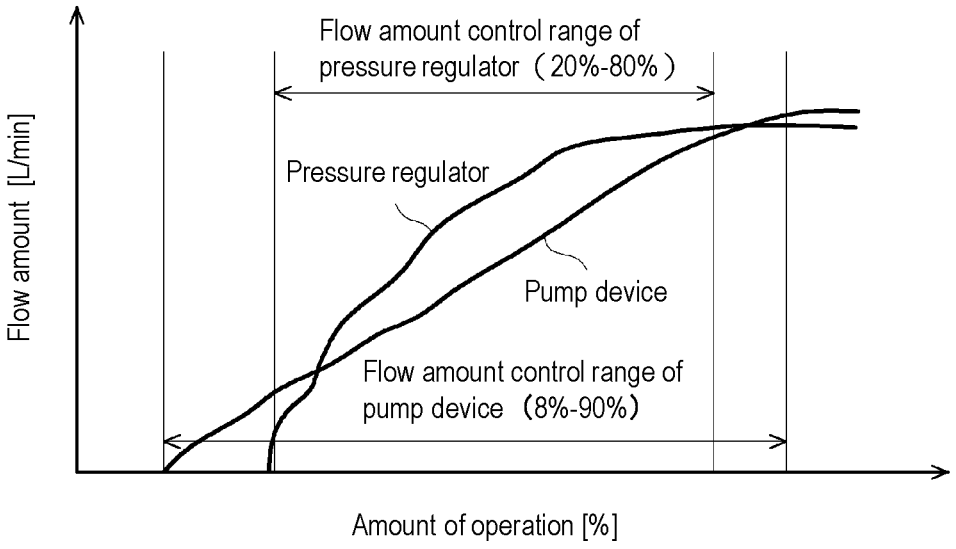
FIG. 2 is a diagram illustrating comparison between a flow amount control range of a pump device and a flow amount control range of an air operation-type pressure regulator.

FIG. 2 is a diagram illustrating comparison between a flow amount control range of the pump device and a flow amount control range of an air operation-type pressure regulator. Hereinafter, problems in a case in which the pressure regulator is provided instead of the pump device 32 will be described with reference to FIG. 2.

In FIG. 2, the horizontal axis represents the amount of operation [%] while the vertical axis represents the flow amount [L/min]. The air operation-type pressure regulator controls the flow amount of liquid on the basis of compressed air supplied to the pressure regulator. As is obvious from the graph representing a correlation between the amount of operation of the pressure regulator and the flow amount of liquid, the flow amount of liquid significantly changes with a small amount of operation of the pressure regulator in the small flow amount region.

On the other hand, as is obvious from the graph representing a correlation between the amount of operation of the pump device 32 and the flow amount of liquid, the flow amount of liquid has a small change with a small amount of operation of the pump device 32 in both the small flow amount region and the large flow amount region. The pump device 32 can thus precisely control the flow amount of liquid from the small flow amount region to the large flow amount region.

In this embodiment, since the pad temperature adjustment system 5 includes the pump device 32, it is possible to precisely control the flow amount of liquid to be supplied to the heat exchanging member 11 in a wide range from the small flow amount region to a large flow amount region. With such a configuration, the pad temperature adjustment system 5 can precisely adjust the surface temperature of the polishing pad 3.

Figure 3:
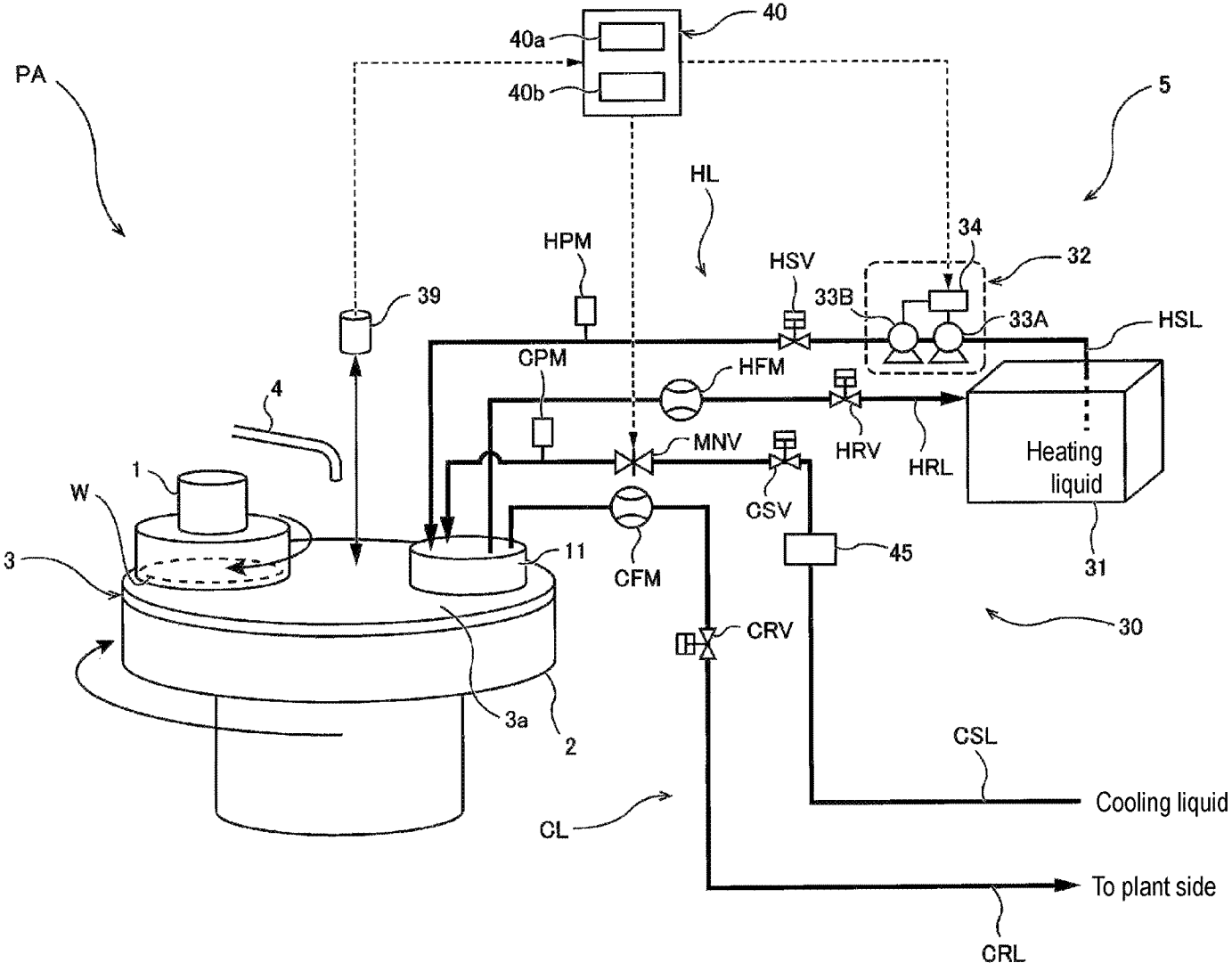
FIG. 3 is a diagram illustrating another embodiment of a pump device.

FIG. 3 is a diagram illustrating another embodiment of a pump device. Since configurations and operations of this embodiment that will not be described in particular are the same as those in the aforementioned embodiment, repeated description thereof will be omitted. As illustrated in FIG. 3, the pump device 32 may include a plurality (two in the embodiment illustrated in FIG. 3) pumps 33A and 33B disposed in series in the flowing direction of the liquid flowing through the heating liquid supply line HSL and a pump controller 34 that controls operations of the pumps 33A and 33B. The number of pumps 33 is not limited in the embodiments illustrated in FIGS. 1 and 3. Three or more pumps 33 may be provided.

In the embodiment illustrated in FIG. 3, each of the pumps 33A and 33B is a pump that can operate at a low speed. In a case in which a small flow amount of heating liquid is supplied to the heat exchanging member 11, either the pump 33A or 33B is operated. In a case in which a large flow amount of heating liquid is supplied to the heat exchanging member 11, both the pumps 33A and 33B are operated. With such a configuration, the pump device 32 can more precisely control the flow amount of liquid to be supplied to the heat exchanging member 11.

Returning to FIG. 1, a heating liquid supply valve HSV and a pressure sensor HPM are attached to the heating liquid supply line HSL. The heating liquid supply valve HSV is an opening/closing valve that opens and closes the flow path of the heating liquid supply line HSL and is disposed on a downstream side of the pump device 32. The pressure sensor HPM is disposed on a downstream side of the heating liquid supply valve HSV.

A heating liquid returning valve HRV that opens and closes the flow path of the heating liquid returning line HRL and a flow amount sensor HFM that measures the flow amount of the liquid flowing through the heating liquid returning line HRL are attached to the heating liquid returning line HRL. The flow amount sensor HFM is disposed on an upstream side of the heating liquid returning valve HRV.

The heating liquid supply valve HSV, the pressure sensor HPM, the heating liquid returning valve HRV, and the flow amount sensor HFM are electrically connected to the control device 40.

The cooling liquid line CL includes a cooling liquid supply line CSL and a cooling liquid returning line CRL that are coupled to the heat exchanging member 11. The cooling liquid supply line CSL is connected to a cooling liquid supply source (for example, a cooling water supply source) provided in a plant where the polishing apparatus PA is placed. Note that illustration of the cooling liquid supply source is omitted. The cooling liquid is supplied to the heat exchanging member 11 through the cooling liquid supply line CSL and is then returned from the heat exchanging member 11 to the cooling liquid supply source through the cooling liquid returning line CRL.

A cooling liquid supply valve CSV, a motor needle valve MNV, and a pressure sensor CPM are attached to the cooling liquid supply line CSL. The cooling liquid supply valve CSV is an opening/closing valve that opens and closes the flow path of the cooling liquid supply line CSL.

Hereinafter, the motor needle valve may simply be referred to as a needle valve. The needle valve MNV is disposed on a downstream side of the cooling liquid supply valve CSV while the pressure sensor CPM is disposed on a downstream side of the needle valve MNV. The control device 40 is electrically connected to the needle valve MNV and can control operations of the needle valve MNV.

In the embodiment illustrated in FIG. 1, the flow amount of cooling liquid to be supplied to the heat exchanging member 11 is controlled by the needle valve MNV (and the control device 40). The needle valve MNV connected to the cooling liquid supply line CSL can control the flow amount of cooling liquid in a flow amount control range that is a wide range from a small flow amount region to a large flow amount region. The pad temperature adjustment system 5 can thus precisely control the flow amount of cooling liquid flowing through the cooling liquid supply line CSL.

Figure 4:
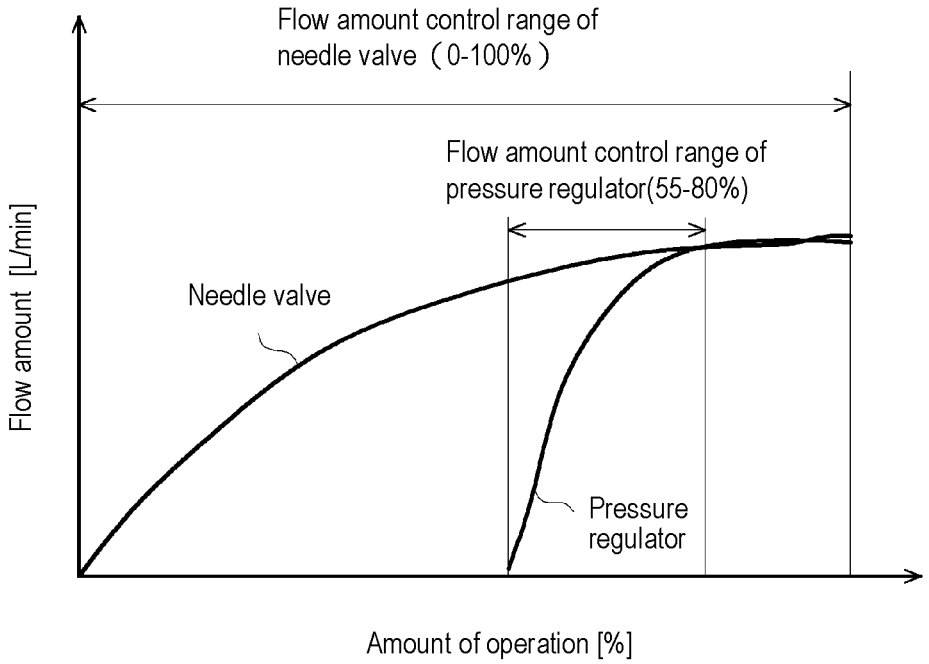
FIG. 4 is a diagram illustrating comparison between a flow amount control range of a needle valve and a flow amount control range of an air operation-type pressure regulator.

FIG. 4 is a diagram illustrating comparison between a flow amount control range of the needle valve and a flow amount control range of the air operation-type pressure regulator. In FIG. 4, the horizontal axis represents the amount of operation [%] while the vertical axis represents the flow amount [L/min]. As is obvious from the graph representing a correlation between the amount of operation of the pressure regulator and the flow amount of liquid, the flow amount control range of the pressure regulator is 55 to 80%.

On the other hand, as is obvious from the graph representing a correlation between the amount of operation of the needle valve MNV and the flow amount of liquid, the flow amount control range of the needle valve MNV is 0 to 100%, and the needle valve MNV can precisely control the flow amount of liquid from the small flow amount region to the large flow amount region.

In this embodiment, since the liquid supply unit 30 includes the needle valve MNV, the flow amount of liquid to be supplied to the heat exchanging member 11 can precisely be controlled in a wide range from the small flow amount region to the large flow amount region. With such a configuration, the pad temperature adjustment system 5 can precisely adjust the surface temperature of the polishing pad 3.

The pressure regulator includes a large number of components (for example, a DA unit, an electropneumatic regulator, and a regulator body). On the other hand, the needle valve MNV includes a small number of components (for example, a DA unit and a needle valve body). Therefore, in a case in which the control device 40 controls operations of the needle valve MNV, responsiveness of the needle valve MNV to the control device 40 is higher than responsiveness of the pressure regulator. Further, since the number of components of the needle valve MNV is small, the needle valve MNV can reduce the probability of failure of the needle valve MNV itself. It is thus possible to enhance safety of the liquid supply unit 30.

Returning to FIG. 1, a cooling liquid returning valve CRV and a flow amount sensor CFM that measures the flow amount of liquid flowing through the cooling liquid returning line CRL are attached to the cooling liquid returning line CRL. The flow amount sensor CFM is disposed on an upstream side of the cooling liquid returning valve CRV.

The cooling liquid supply valve CSV, the pressure sensor CPM, the cooling liquid returning valve CRV, and the flow amount sensor CFM are electrically connected to the control device 40.

The pad temperature adjustment system 5 further includes a pad temperature measurement tool 39 that measures the surface temperature of the polishing pad 3. The pad temperature measurement tool 39 is disposed above the surface 3*a*of the polishing pad 3 and is configured to measure the surface temperature of the polishing pad 3 in a non-contact manner. The pad temperature measurement tool 39 is electrically connected to the control device 40. The control device 40 controls the pump device 32 and the needle valve MNV such that the surface temperature of the polishing pad 3 reaches an optimal temperature, on the basis of the pad surface temperature measured by the pad temperature measurement tool 39.

As illustrated in FIG. 1, the liquid supply unit 30 may include a pulsation attenuator 45 (that is, a damper) that is disposed on an upstream side of the needle valve MNV in the flowing direction of the liquid flowing through the cooling liquid supply line CSL. The pulsation attenuator 45 is configured to curb variations in pressure of the liquid flowing through the cooling liquid supply line CSL. By providing the pulsation attenuator 45, the needle valve MNV can precisely control the flow amount of liquid, in particular, the flow amount of liquid in the large flow amount region without being affected by the variations in pressure of the liquid.

Figure 5:
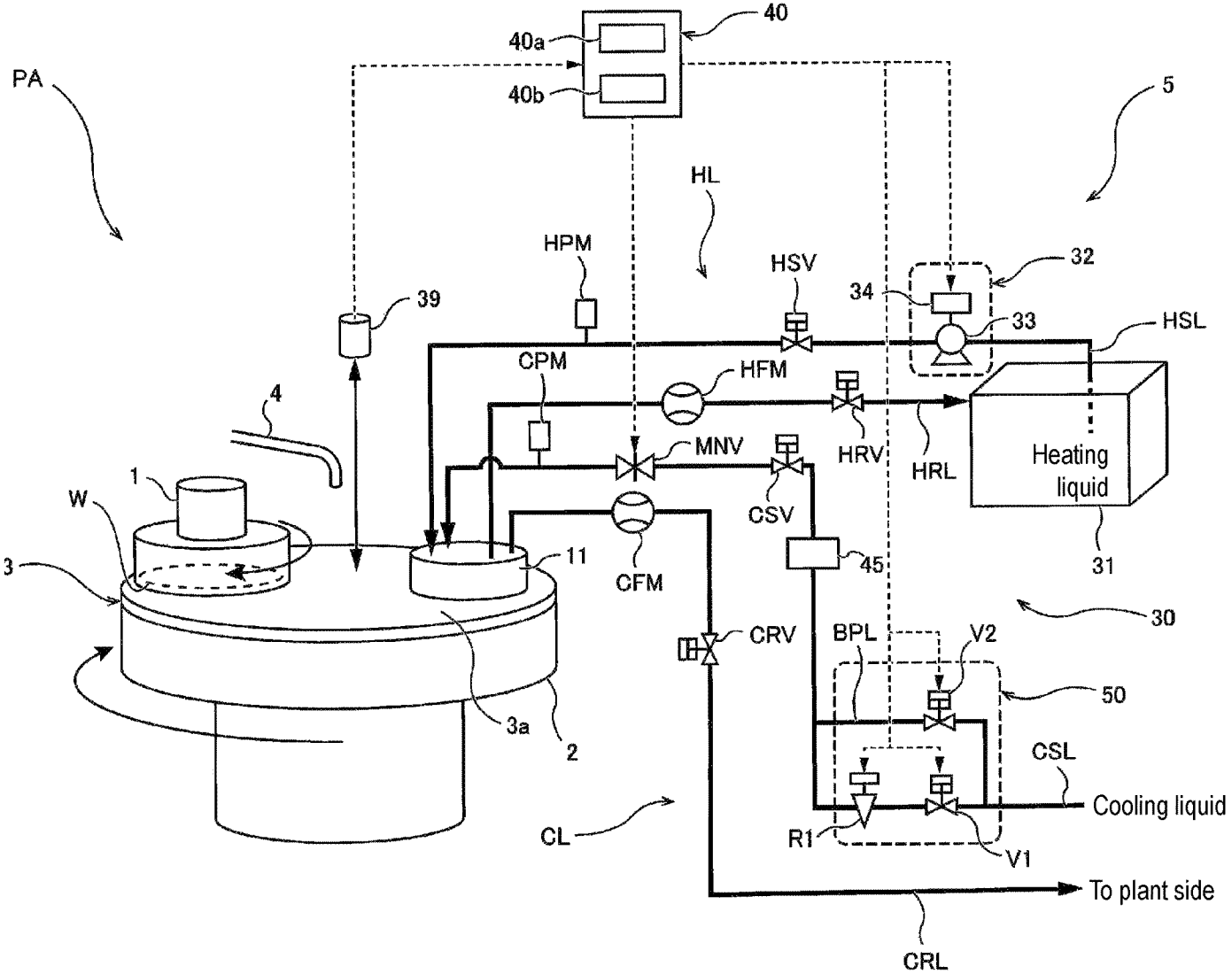
FIG. 5 is a diagram illustrating another embodiment of a liquid supply unit.

FIG. 5 is a diagram illustrating another embodiment of a liquid supply unit. Since configurations and operations of this embodiment that will not be described in particular are the same as those in the aforementioned embodiments, repeated description will be omitted. As illustrated in FIG. 5, the liquid supply unit 30 may include a flow amount switching unit 50 that switches the flow amount of liquid flowing through the cooling liquid supply line CSL. The flow amount switching unit 50 includes a pressure regulator R1 and a first opening/closing valve V1 that are attached to the cooling liquid supply line CSL, a bypass line BPL that bypasses the pressure regulator R1 and the first opening/closing valve V1, and a second opening/closing valve V2 that is attached to the bypass line BPL.

The flow amount switching unit 50 switches the flow amount of liquid to be supplied to the heat exchanging member 11 through the cooling liquid supply line CSL between a first flow amount (large flow amount) and a second flow amount (small flow amount) that is smaller than the first flow amount through opening and closing operations of the first opening/closing valve V1 and opening and closing operations of the second opening/closing valve V2.

More specifically, the flow amount switching unit 50 supplies liquid to the heat exchanging member 11 through the bypass line BPL (and the cooling liquid supply line CSL) by closing the first opening/closing valve V1 and opening the second opening/closing valve V2. Through such operations, the needle valve MNV precisely controls the flow amount of the liquid in the large flow amount region that passes through the needle valve MNV itself.

The flow amount switching unit 50 supplies the liquid to the heat exchanging member 11 only through the cooling liquid supply line CSL by opening the first opening/closing valve V1 and closing the second opening/closing valve V2. The flow amount of liquid flowing through the cooling liquid supply line CSL is controlled to be the second flow amount by the pressure regulator R1. Through such operations, the needle valve MNV precisely controls the flow amount of liquid in the small flow amount region that passes through the needle valve MNV itself.

More specifically, the pressure regulator R1 controls the flow amount of liquid flowing through the cooling liquid supply line CSL while the needle valve MNV controls the flow amount of liquid restricted to the small flow amount by the pressure regulator R1. The needle valve MNV can thus precisely control the flow amount of liquid flowing through the cooling liquid supply line CSL.

Figure 6:
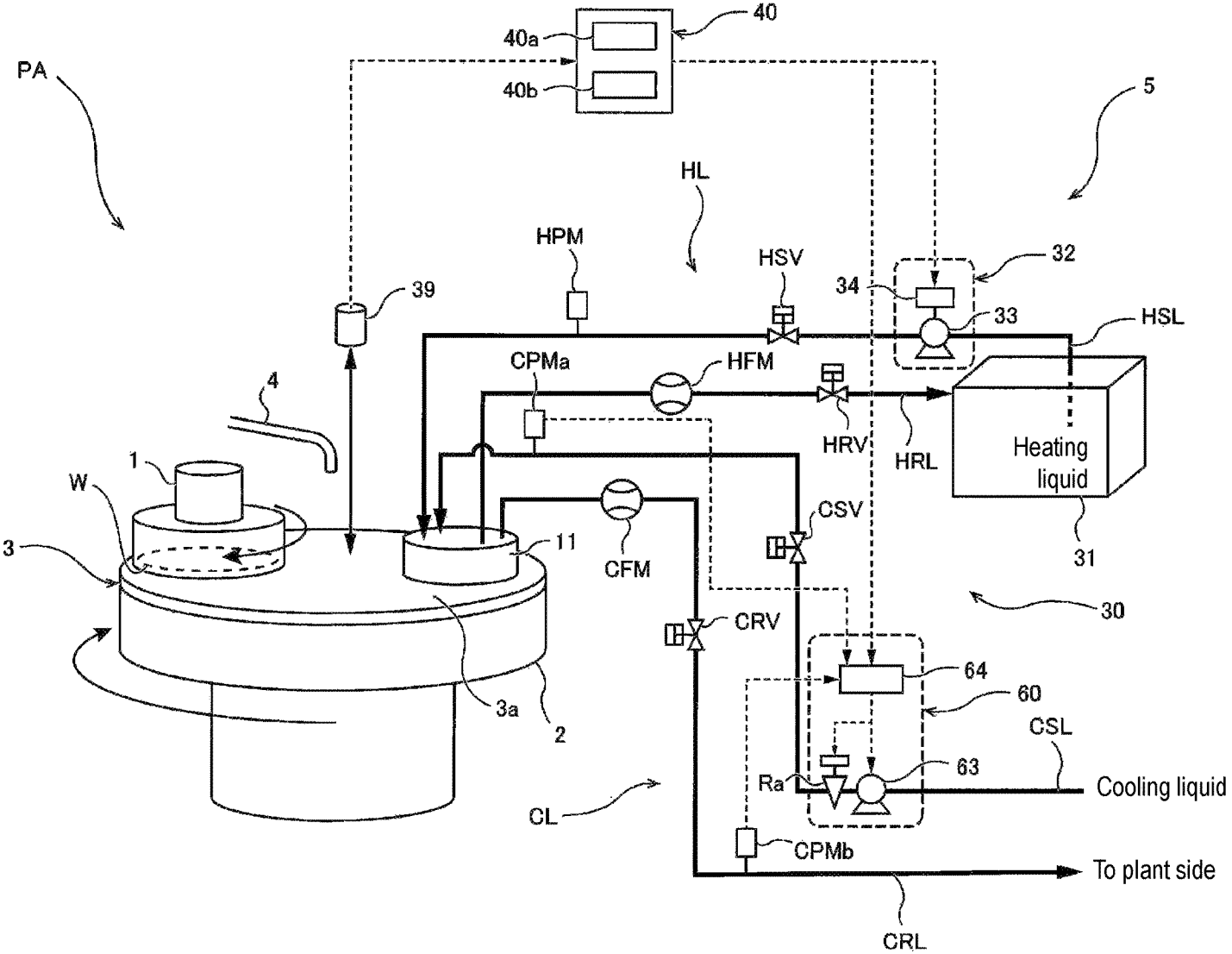
FIG. 6 is a diagram illustrating yet another embodiment of a liquid supply unit.

FIG. 6 is a diagram illustrating yet another embodiment of a liquid supply unit. Since configurations and operations of this embodiment that will not be described in particular are the same as those in the aforementioned embodiments, repeated description thereof will be omitted.

As illustrated in FIG. 6, the liquid supply unit 30 includes a pump unit (pressure boosting unit) 60 that can operate on the basis of a pressure difference between a pressure of the liquid flowing through the cooling liquid supply line CSL and a pressure of the liquid flowing through the cooling liquid returning line CRL.

Although the liquid supply unit 30 includes the needle valve MNV in the aforementioned embodiment, the liquid supply unit 30 includes a pressure regulator Ra instead of the needle valve MNV in the embodiment illustrated in FIG. 6.

The pump unit 60 includes a pump 63 that is connected to the cooling liquid supply line CSL and a pump controller 64 that controls operations of the pump 63. The pump controller 64 is electrically connected to the control device 40 and controls operations of the pump 63 on the basis of commands from the control device 40.

In the embodiment illustrated in FIG. 6, the pump unit 60 includes a pressure regulator Ra, and the pressure regulator Ra is adjacent to the pump 63 and is disposed on a downstream side of the pump 63. The pressure regulator Ra is electrically connected to the pump controller 64, and the pump controller 64 can control operations of the pressure regulator Ra. In one embodiment, the pressure regulator Ra is electrically connected to the control device 40, and the control device 40 can control operations of the pressure regulator Ra.

The liquid supply unit 30 includes a supply-side pressure sensor CPMa that is attached to the cooling liquid supply line CSL and a returning-side pressure sensor CPMb that is attached to the cooling liquid returning line CRL. The control device 40 calculates a pressure difference on the basis of a pressure measured by the supply-side pressure sensor CPMa and a pressure measured by the returning-side pressure sensor CPMb and controls operations of the pump unit 60 such that the calculated pressure difference reaches a target pressure on the basis of a correlation between the flow amount of liquid flowing through the cooling liquid supply line CSL and the pressure difference between the pressure of the liquid flowing through the cooling liquid supply line CSL and the pressure of the liquid flowing through the cooling liquid returning line CRL.

As illustrated in FIG. 6, the control device 40 includes a storage device 40*a* that stores a program and a processing device 40*b* that executes arithmetic operations in accordance with the program. The control device 40 configured of a computer operates in accordance with the program electrically stored in the storage device 40*a*. The program includes at least commands for causing the pump unit 60 to operate.

The aforementioned program is stored in a non-transitory tangible computer-readable recording medium and is then provided to the control device 40 via the recording medium. Alternatively, the program may be input from a communication device (not illustrated) to the control device 40 via a communication network such as the Internet or a local area network.

The supply-side pressure sensor CPMa and the returning-side pressure sensor CPMb may be electrically connected to the control device 40. In the embodiment illustrated in FIG. 6, the supply-side pressure sensor CPMa and the returning-side pressure sensor CPMb are electrically connected to the pump controller 64. Therefore, the pump controller 64 calculates the pressure difference on the basis of the pressure measured by the supply-side pressure sensor CPMa and the pressure measured by the returning-side pressure sensor CPMb and controls operations of the pump 63 such that the calculated pressure difference reaches the target pressure on the basis of the aforementioned correlation. The pump controller 64 may have a configuration that is similar to that of the control device 40 and can operate in accordance with commands from the control device 40. During operations of the pump 63, the pump controller 64 fully opens the pressure regulator Ra.

A correlation is present between the pressure difference and the flow amount. More specifically, the flow amount and the pressure difference increase depending on the amount of operation as the amount of operation increases, and the flow amount and the pressure difference decreases depending on the amount of operation as the amount of operation decreases. The control apparatus 40 controls the flow amounts of liquids (the heating liquid and the cooling liquid) to be supplied to the heat exchanging member 11 to satisfy the following expression.

The amount of operation of the cooling liquid [%]=(100−the amount of operation of the heating liquid) [%]

In other words, on the assumption that the flow amount of liquid (including the heating liquid and the cooling liquid) when the amount of operation is 100% is 6 L/min, the flow amount [L/min] of cooling liquid satisfies the following expression.

The flow amount of the cooling liquid [L/min]=(6−the flow amount of heating liquid) [L/min]

The control device 40 calculates a targeted pressure difference (target pressure) from a currently needed flow amount on the basis of the aforementioned correlation. The control device 40 controls the flow amount of cooling liquid to be supplied to the heat exchanging member 11 such that the pressure difference calculated on the basis of the pressure measured by the supply-side pressure sensor CPMa and the pressure measured by the returning-side pressure sensor CPMb reaches the target pressure. A database corresponding to the aforementioned correlation is stored in the storage device 40*a*.

In this manner, the control device 40 controls the flow amount of cooling liquid on the basis of the pressure difference. Therefore, the liquid supply unit 30 can secure a constant flow amount with respect to the amount of operation even if the back pressure of the plant facility varies. As a result, the liquid supply unit 30 can enhance stability of the surface temperature of the polishing pad 3. According to the embodiment illustrated in FIG. 6, the control device 40 can execute monitoring of abnormalities such as variations in pressure of the cooling liquid supply source, variations in back pressure, and blockage of the cooling liquid supply line CSL.

The pump controller 64 (or the control device 40) causes the pressure regulator Ra to operate and controls the flow amount of cooling liquid in a case in which driving of the pump unit 60 is stopped, that is, in a case in which the rotation speed of the pump 63 reaches 0 $min^{-1}$.

The case in which the rotation speed of the pump 63 reaches 0 $min^{-1}$ is, for example, a following case. A supply pressure acts on a liquid introduced from a cooling liquid supply source provided in the plant to the cooling liquid supply line CSL. In a case in which a large flow amount of liquid is supplied, the pump unit 60 is caused to operate to boost the supply pressure of the liquid. On the other hand, the supply pressure of the liquid does not become lower than the supply pressure of the liquid introduced from the cooling liquid supply source even if the driving of the pump unit 60 is stopped. Therefore, in a case in which a small flow amount of liquid is supplied, the pump controller 64 stops the driving of the pump unit 60 and controls the flow amount of cooling liquid using the pressure regulator Ra.

Figure 7:
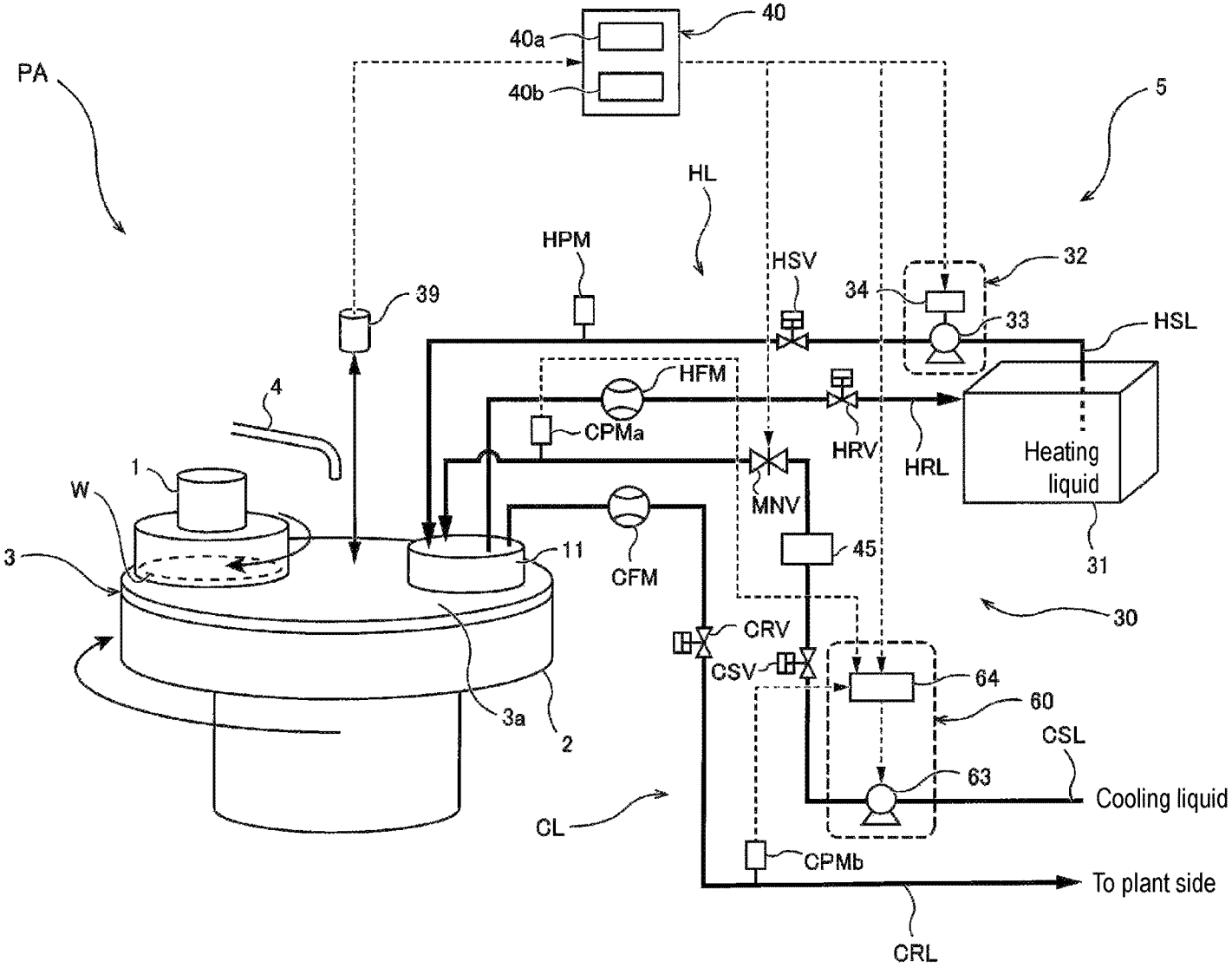
FIG. 7 is a diagram illustrating yet another embodiment of a liquid supply unit.

FIG. 7 is a diagram illustrating yet another embodiment of a liquid supply unit. Since configurations and operations of this embodiment that will not be described in particular are the same as those in the aforementioned embodiments, repeated description thereof will be omitted.

Although the liquid supply unit 30 includes the pressure regulator Ra in the embodiment illustrated in FIG. 6, the liquid supply unit 30 includes the needle valve MNV instead of the pressure regulator Ra in the embodiment illustrated in FIG. 7. Even in this case, the control device 40 causes the needle valve MNV to operate to control the flow amount of cooling liquid in a case in which the driving of the pump unit 60 is stopped. As illustrated in FIG. 7, the liquid supply unit 30 may include the pulsation attenuator 45 disposed on an upstream side of the needle valve MNV.

Figure 8:
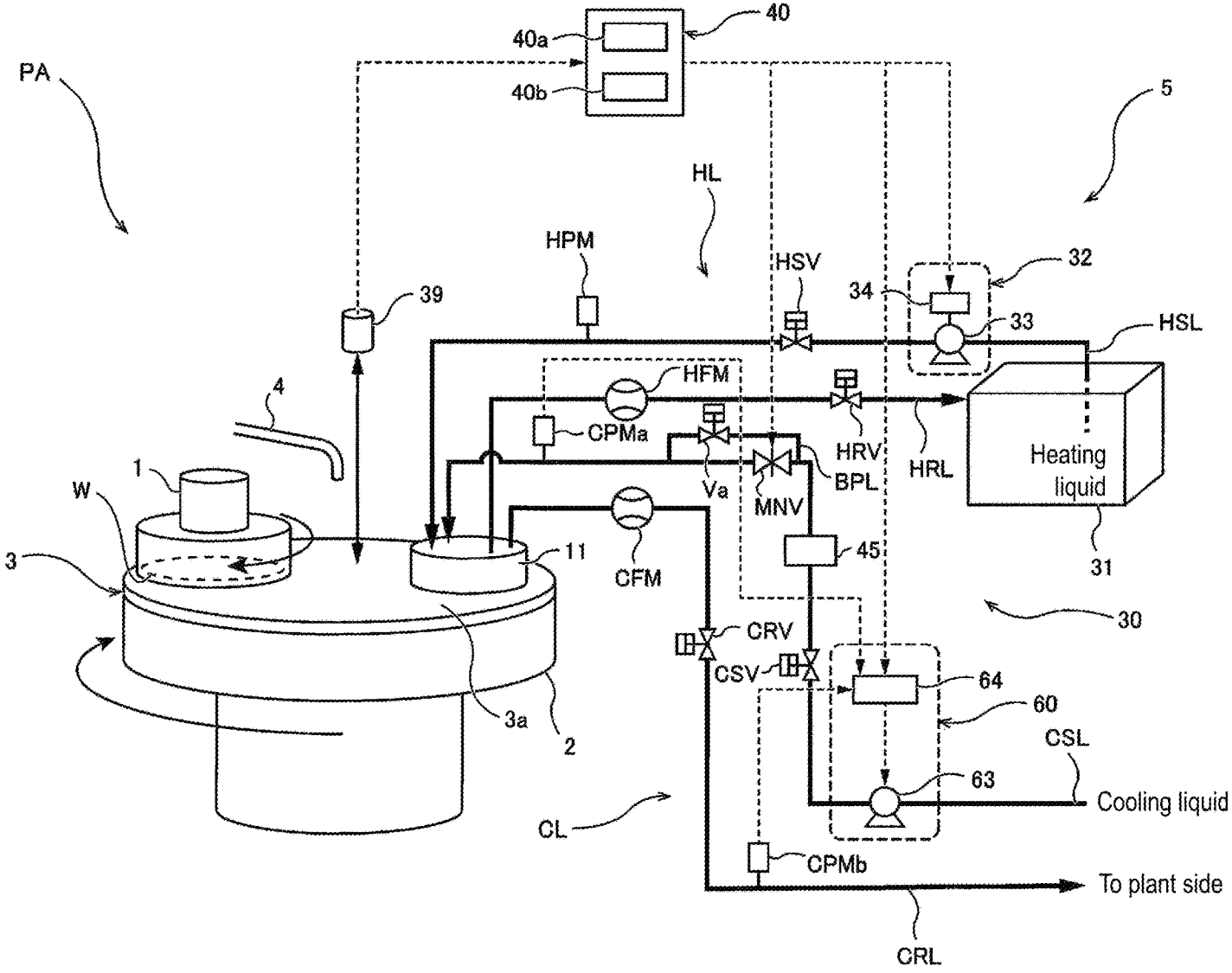
FIG. 8 is a diagram illustrating yet another embodiment of a liquid supply unit.

FIG. 8 is a diagram illustrating yet another embodiment of a liquid supply unit. Since configurations and operations of this embodiment that will not be described in particular are the same as those in the aforementioned embodiment, repeated description will be omitted. As illustrated in FIG. 8, the liquid supply unit 30 includes the needle valve MNV attached to the cooling liquid supply line CSL, the bypass line BPL that bypasses the needle valve MNV, and an opening/closing valve Va that is attached to the bypass line BPL.

The needle valve MNV and the opening/closing valve Va are electrically connected to the control device 40. If the control device 40 closes the opening/closing valve Va, then the liquid flowing through the cooling liquid supply line CSL passes through the cooling liquid supply line CSL to which the needle valve MNV is attached without passing through the bypass line BPL and is then supplied to the heat exchanging member 11. If the control device 40 opens the opening/closing valve Va, then the liquid passes through both the bypass line BPL and the cooling liquid supply line CSL and is then supplied to the heat exchanging member 11.

As illustrated in FIG. 8, the liquid supply unit 30 may include the pulsation attenuator 45 disposed on an upstream side of the needle valve MNV in the flowing direction of the liquid flowing through the cooling liquid supply line CSL.

The control device 40 may switch first control for controlling the flow amount of liquid in the small flow amount region and second control for controlling the flow amount of liquid in the large flow amount region in accordance with a needed flow amount.

In a case in which the control device 40 executes the first control, the control device 40 stops the driving of the pump unit 60 and closes the opening/closing valve Va. Then, the liquid passes only through the cooling liquid supply line CSL to which the needle valve MNV is attached without passing through the bypass line BPL. The control device 40 causes the needle valve MNV to operate to control the flow amount of the liquid to be supplied to the heat exchanging member 11 in the small flow amount region.

In a case in which the control device 40 executes the second control, the control device 40 opens the opening/closing valve Va and fully opens the needle valve MNV. Then, the liquid passes through both the bypass line BPL and the cooling liquid supply line CSL. The needle valve MNV has a relatively large fluid resistance. Therefore, the liquid supply unit 30 can increase the flow amount of liquid to be supplied to the heat exchanging member 11 by opening the opening/closing valve Va and causing the liquid to pass not only through the cooling liquid supply line CSL but also through the bypass line BPL. The control device 40 causes the pump unit 60 to operate to control the flow amount of the liquid to be supplied to the heat exchanging member 11 in the large flow amount region.

In this manner, the control device 40 has a configuration of switching the first control and the second control. Therefore, the control device 40 can precisely control the flow amount of liquid in the small flow amount region and the flow amount of liquid in the large flow amount region.

Figure 9:
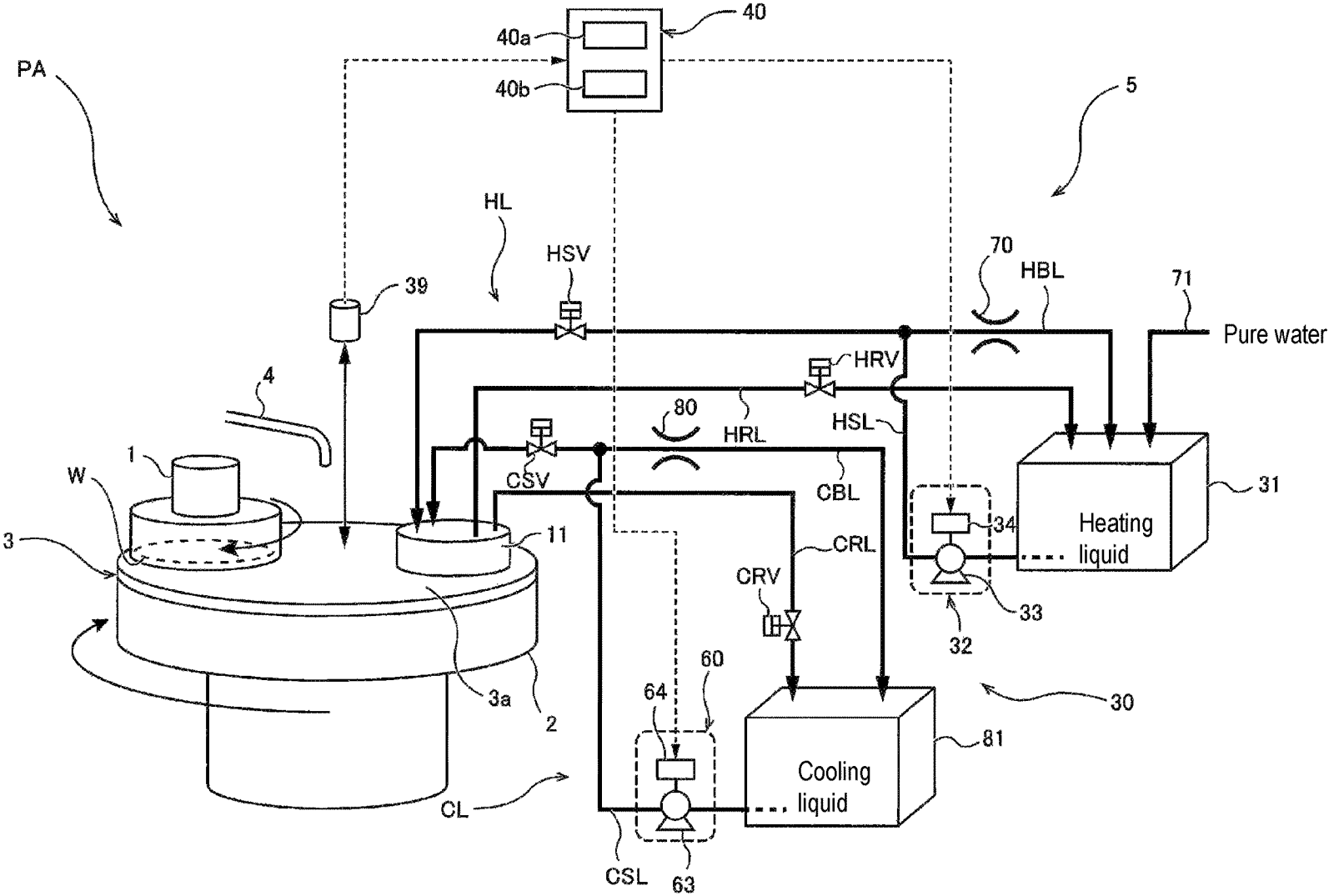
FIG. 9 is a diagram illustrating yet another embodiment of a liquid supply unit.

FIG. 9 is a diagram illustrating yet another embodiment of a liquid supply unit. Since configurations and operations of this embodiment that will not be described in particular are the same as those in the aforementioned embodiments, repeated description thereof will be omitted. In FIG. 9, illustration of elements other than main components is omitted.

As illustrated in FIG. 9, the liquid supply unit 30 includes a heating liquid branching line HBL that is branched from the heating liquid supply line HSL and a cooling liquid branching line CBL that is branched from the cooling liquid supply line CSL.

One end of the heating liquid branching line HBL is connected to the heating liquid supply line HSL, and the other end thereof is connected to the heating liquid supply tank 31. The heating liquid branching line HBL includes an orifice 70 that restricts the flow amount of heating liquid passing through the heating liquid branching line HBL. If the pump device 32 is driven, then the large flow amount of heating liquid is supplied to the heat exchanging member 11 through the heating liquid supply line HSL, and the small flow amount of heating liquid is returned to the heating liquid supply tank 31 through the heating liquid branching line HBL.

In the embodiment illustrated in FIG. 9, a circulation flow of the heating liquid (large circulation flow) that circulates between the heating liquid supply tank 31 and the heat exchanging member 11 is formed by the heating liquid supply line HSL and the heating liquid returning line HRL. A circulation flow of the heating liquid (small circulation flow) is formed by a part of the heating liquid supply line HSL and the heating liquid branching line HBL. The flow amount of heating liquid to be supplied to the heat exchanging member 11 is controlled by the pump device 32. The heating liquid in the heating liquid supply tank 31 is circulated by forming the small circulation flow of the heating liquid, and as a result, the temperature of the heating liquid is constantly maintained.

As illustrated in FIG. 9, the liquid supply unit 30 may further include an auxiliary liquid supply line 71 connected to the heating liquid supply tank 31. The heating liquid in the heating liquid supply tank 31 is gradually evaporated with elapse of time. Therefore, the auxiliary liquid supply line 71 may be provided in order to constantly maintain the amount of heating liquid stored in the heating liquid supply tank 31. In the embodiment illustrated in FIG. 9, the auxiliary liquid supplied to the heating liquid supply tank 31 is pure water.

In the aforementioned embodiments, the cooling liquid supply line CSL is connected to the cooling liquid supply source provided in the plant where the polishing apparatus PA is placed. In the embodiment illustrated in FIG. 9, the cooling liquid supply line CSL and the cooling liquid returning line CRL are connected to a cooling liquid supply tank 81.

One end of the cooling liquid branching line CBL is connected to the cooling liquid supply line CSL, and the other end thereof is connected to the cooling liquid supply tank 81. The cooling liquid branching line CBL includes an orifice 80 that restricts the flow amount of cooling liquid passing through the cooling liquid branching line CBL.

In the embodiment illustrated in FIG. 9, the needle valve MNV is not provided, and instead, the pump unit 60 is provided. If the pump unit 60 is driven, then the large flow amount of cooling liquid is supplied to the heat exchanging member 11 through the cooling liquid supply line CSL, and the small flow amount of cooling liquid is returned to the cooling liquid supply tank 81 through the cooling liquid branching line CBL.

A circulation flow of the cooling liquid (large circulation flow) that circulates between the cooling liquid supply tank 81 and the heat exchanging member 11 is formed by the cooling liquid supply line CSL and the cooling liquid returning line CRL. A circulation flow of the cooling liquid (small circulation flow) is formed by a part of the cooling liquid supply line CSL and the cooling liquid branching line CBL. The flow amount of cooling liquid to be supplied to the heat exchanging member 11 is controlled by the pump unit 60. The cooling liquid in the cooling liquid supply tank 81 is circulated by forming the small circulation flow of the cooling liquid, and as a result, the temperature of the cooling liquid is constantly maintained.

The plurality of aforementioned embodiments may be combined as long as the combination are possible. For example, the embodiment illustrated in FIG. 3 and the embodiment illustrated in FIG. 6 may be combined. In this case, the liquid supply unit 30 according to the embodiment illustrated in FIG. 6 includes the pump device 32 including the plurality of pumps 33A and 33B.

In one embodiment, the embodiment illustrated in FIG. 6 and the embodiment illustrated in FIG. 9 may be combined. The control device 40 may control operations of the pump unit 60 on the basis of the pressure difference between the pressure measured by the supply-side pressure sensor CPMa (see FIG. 6) and the pressure measured by the returning-side pressure sensor CPMb.

The aforementioned embodiments have been described for the purpose of allowing those who have ordinary skills in the art to which the present invention belongs to be able to perform the present invention. Various modifications of the aforementioned embodiments can be achieved by those skilled in the art as a matter of course, and technical ideas of the present invention can be applied to other embodiment as well. Therefore, the present invention is not limited to the described embodiments and is to be interpreted in the widest range in accordance with the technical ideas defined by the claims.

It will be apparent to those skilled in the art that various modifications and variations can be made to the disclosed embodiments without departing from the scope or spirit of the disclosure. In view of the foregoing, it is intended that the disclosure covers modifications and variations provided so that they fall within the scope of the following claims and their equivalents.

What is claimed is:

1. A system, comprising:

a heat exchanging member that is capable of exchanging heat with a surface of a polishing pad; and a liquid supply unit that supplies a liquid to the heat exchanging member, wherein the liquid supply unit comprises a pump device that adjusts a flow amount of a liquid flowing through a heating liquid supply line, a needle valve that is attached to a cooling liquid supply line, a pulsation attenuator attached to a cooling liquid supply line, a cooling liquid supply valve that is attached to the cooling liquid supply line, a pressure sensor that is attached to the cooling liquid supply line, and a control device that controls operations of the pump device and the needle valve, wherein the needle valve is disposed on a downstream side of the cooling liquid supply valve, the pulsation attenuator is disposed on an upstream side of the cooling liquid supply valve, the pressure sensor is disposed on a downstream side of the needle valve, and the heat exchanging member is disposed on a downstream side of the pressure sensor, wherein the downstream sides and the upstream sides are with respect to a flow direction of the liquid flow through the cooling liquid supply line.

2. The system according to claim 1, wherein the liquid supply unit comprises a flow amount switching unit that switches a flow amount of a liquid flowing through the cooling liquid supply line.

3. The system according to claim 2, wherein the flow amount switching unit comprises a pressure regulator and a first opening/closing valve that are attached to the cooling liquid supply line, a bypass line that bypasses the pressure regulator and the first opening/closing valve, and a second opening/closing valve that is attached to the bypass line.

4. The system according to claim 1, wherein the pump device comprises at least one pump, and a pump controller that controls operations of the pump.

5. A polishing apparatus, comprising:

a polishing head that holds a substrate and causes the substrate to rotate;

a polishing table that supports a polishing pad;

a polishing solution supply nozzle that supplies a polishing solution to a surface of the polishing pad; and the system according to claim 1.

6. A system, comprising:

a heat exchanging member that is capable of exchanging heat with a surface of a polishing pad; and a liquid supply unit that supplies a liquid to the heat exchanging member, wherein the liquid supply unit comprises a pump device that adjusts a flow amount of a liquid flowing through a heating liquid supply line, a pump unit that is capable of operating on the basis of a pressure difference between a pressure of a liquid flowing through a cooling liquid supply line and a pressure of a liquid flowing through a cooling liquid returning line, and comprises at least one first pump and a first pump controller that controls operations of the at least one first pump a pressure regulator that is attached to the cooling liquid supply line, a cooling liquid supply valve attached to the cooling liquid supply line, a supply-side pressure sensor attached to the cooling liquid supply line, and a control device that controls operations of the pump device and the pump unit, wherein the first pump controller causes the pressure regulator to operate and controls the flow amount of cooling liquid in a case in which driving of the pump unit is stopped, and the pressure regulator is disposed on a downstream side of the pump unit, the cooling liquid supply valve is disposed on a downstream side of the pressure regulator, the supply-side pressure sensor is disposed on a downstream side of the cooling liquid supply valve, and the heat exchanging member is disposed on a downstream side of the supply-side pressure sensor, wherein the downstream sides and the upstream sides are with respect to a flow direction of the liquid flow through the cooling liquid supply line.

7. The system according to claim 6, wherein the liquid supply unit comprises a supply-side pressure sensor that is attached to the cooling liquid supply line, and a returning-side pressure sensor that is attached to the cooling liquid returning line, and the control device calculates a pressure difference on the basis of a pressure measured by the supply-side pressure sensor and a pressure measured by the returning-side pressure sensor, and controls operations of the pump unit such that the calculated pressure difference reaches a target pressure on the basis of a correlation between the flow amount of the liquid flowing through the cooling liquid supply line and the pressure difference between the pressure of the liquid flowing through the cooling liquid supply line and the pressure of the liquid flowing through the cooling liquid returning line.

8. The system according to claim 6, wherein the liquid supply unit comprises a needle valve that is attached to the cooling liquid supply line, a bypass line that bypasses the needle valve, and an opening/closing valve that is attached to the bypass line.

9. The system according to claim 8, wherein the liquid supply unit comprises a pulsation attenuator disposed on an upstream side of the needle valve in a flowing direction of the liquid flowing through the cooling liquid supply line.

10. The system according to claim 6, wherein the pump device comprises at least one pump, and a pump controller that controls operations of the second pump.

11. A polishing apparatus, comprising:

a polishing head that holds a substrate and causes the substrate to rotate;

a polishing table that supports a polishing pad;

a polishing solution supply nozzle that supplies a polishing solution to a surface of the polishing pad; and the system according to claim 6.

12. A system, comprising:

a heat exchanging member that is capable of exchanging heat with a surface of a polishing pad; and a liquid supply unit that supplies a liquid to the heat exchanging member, wherein the liquid supply unit comprises a pump device that adjusts a flow amount of a liquid flowing through a heating liquid supply line, a needle valve that is attached to a cooling liquid supply line, a pump unit that is capable of operating on the bases of a pressure difference between a pressure of a liquid flowing through the cooling liquid supply line and a pressure of a liquid flowing through a cooling liquid returning line, wherein the pump unit comprises a pressure regulator, at least one pump, and a pump controller that controls operations of the at least one pump, a cooling liquid supply valve attached to the cooling liquid supply line, a supply-side pressure sensor attached to the cooling liquid supply line, and a control device that controls operations of the pump device, the needle valve, and the pump unit, wherein the pump controller causes the pressure regulator to operate and controls the flow amount of cooling liquid in a case in which driving of a pump unit is stopped, and the needle valve is disposed on a downstream side of the pump unit, the cooling liquid supply valve is disposed on a downstream side of the needle valve, the supply-side pressure sensor is disposed on a downstream side of the cooling liquid supply valve, and the heat exchanging member is disposed on a downstream side of the supply-side pressure sensor, wherein the downstream sides and the upstream sides are with respect to a flow direction of the liquid flow through the cooling liquid supply line.

13. A system, comprising:

a heat exchanging member that is capable of exchanging heat with a surface of a polishing pad; and a liquid supply unit that supplies a liquid to the heat exchanging member, wherein the liquid supply unit comprises a pump device that adjusts a flow amount of a liquid flowing through a heating liquid supply line, a needle valve that is attached to a cooling liquid supply line, a pump unit that is capable of operating on the bases of a pressure difference between a pressure of a liquid flowing through the cooling liquid supply line and a pressure of a liquid flowing through a cooling liquid returning line, a cooling liquid supply valve attached to the cooling liquid supply line, a bypass line that bypasses the needle valve, an opening/closing valve that is attached to the bypass line, and a control device that controls operations of the pump device and the needle valve, wherein the control device executes a first control and a second control, wherein in a case in which the control device executes the first control, the control device stops the driving of the pump unit and closes the opening/closing valve, and causes the needle valve to operate to control a flow amount of the liquid to be supplied to the heat exchanging member in the small flow amount regioin; and in a case in which the control device executes the second control, the control device opens the opening/closing valve and fully opens the needle valve, and causes the pump unit to operate to control the flow amount of the liquid to be supplied to the heat exchanging member in the large flow amount region, and the cooling liquid supply valve is disposed on a downstream side of the pump unit, the bypass line and the needle valve are disposed on a downstream side of the cooling liquid supply valve, and the heat exchanging member is disposed on a downstream side of the bypass line and the needle valve, wherein the downstream sides and the upstream sides are with respect to a flow direction of the liquid flow through the cooling liquid supply line.

* * * * *